US011315542B2

(12) United States Patent
Wang et al.

(10) Patent No.: US 11,315,542 B2
(45) Date of Patent: Apr. 26, 2022

(54) ACTIVE NOISE CONTROL DEVICE

(71) Applicant: HONDA MOTOR CO., LTD., Tokyo (JP)

(72) Inventors: Xun Wang, Wako (JP); Toshio Inoue, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/215,500

(22) Filed: Mar. 29, 2021

(65) Prior Publication Data

US 2021/0304727 A1 Sep. 30, 2021

(30) Foreign Application Priority Data

Mar. 31, 2020 (JP) ..... JP2020-062574
Feb. 8, 2021 (JP) ..... JP2021-017934

(51) Int. Cl.
*G10K 11/178* (2006.01)

(52) U.S. Cl.
CPC .. *G10K 11/17854* (2018.01); *G10K 11/17823* (2018.01); *G10K 11/17883* (2018.01); *G10K 2210/1282* (2013.01); *G10K 2210/1291* (2013.01)

(58) Field of Classification Search
CPC ..... G10K 11/1781; G10K 11/17813; G10K 11/17817; G10K 11/17825; G10K 11/17854; G10K 11/17883; G10K 2210/30232; G10K 2210/3033; G10K 2210/511; G10K 2210/1282; G10K 2210/128
See application file for complete search history.

(56) References Cited

U.S. PATENT DOCUMENTS

2007/0038441 A1* 2/2007 Inoue ..... G10K 11/17883 704/226

FOREIGN PATENT DOCUMENTS

EP 1 772 852 A1 4/2007
JP 2007-025527 A 2/2007

* cited by examiner

*Primary Examiner* — Kile O Blair
(74) *Attorney, Agent, or Firm* — Carrier Blackman & Associates, P.C.; Joseph P. Carrier; William D. Blackman

(57) ABSTRACT

An active noise control device includes: a control target signal extractor for extracting a signal component of a control target frequency from an error signal as a control target signal which is a complex-valued signal having a real part and an imaginary part; a control signal generator for generating a control signal for controlling a control actuator, by signal-processing the control target signal through a control filter; and a control filter coefficient updater for successively and adaptively updating the coefficient of the control filter.

3 Claims, 8 Drawing Sheets

ACTIVE NOISE CONTROL DEVICE

CROSS-REFERENCE TO RELATED APPLICATIONS

This application is based upon and claims the benefit of priority from Japanese Patent Applications No. 2020-062574 filed on Mar. 31, 2020 and No. 2021-017934 filed on Feb. 8, 2021, the contents all of which are incorporated herein by reference.

BACKGROUND OF THE INVENTION

Field of the Invention

The present invention relates to an active noise control device that performs active noise control for controlling a control actuator based on an error signal output from an error detector that detects sound pressure or vibration at a control point.

Description of the Related Art

Japanese Laid-Open Patent Publication No. 2007-025527 discloses a device configuration in which feedback control for generating a control sound output from a speaker is performed by adjusting the amplitude and phase of a noise signal based on the noise signal which an error microphone detects at a control point.

SUMMARY OF THE INVENTION

In the technology of Japanese Laid-Open Patent Publication No. 2007-025527, a fixed value measured in advance is used as the sound transfer characteristic from the speaker to the error microphone. Therefore, there is a concern that amplification of noise and/or generation of abnormal sound may occur when the transfer characteristic changes.

The present invention has been devised to solve the above problems, and it is an object of the present invention to provide an active noise control device capable of ensuring good noise cancelling performance even when the transfer characteristic changes.

An aspect of the present invention resides in an active noise control device that performs active noise control for controlling a control actuator based only on an error signal output from an error detector that detects sound pressure or vibration at a control point, the active noise control device including: a control target signal extractor configured to extract a signal component of a control target frequency from the error signal as a control target signal which is a complex-valued signal having a real part and an imaginary part; a control signal generator configured to generate a control signal for controlling the control actuator, by signal-processing the control target signal through a control filter that is an adaptive notch filter; an estimated noise signal generator configured to generate an estimated noise signal by signal-processing the control target signal through an adjustment filter that is an adaptive notch filter; a first estimated anti-noise signal generator configured to generate a first estimated anti-noise signal by signal-processing the control signal through a secondary path transfer filter that is an adaptive notch filter; a reference signal generator configured to generate a reference signal by signal-processing the control target signal through the secondary path transfer filter; a second estimated anti-noise signal generator configured to generate a second estimated anti-noise signal by signal-processing the reference signal through the control filter; a first virtual error signal generator configured to generate a first virtual error signal from the error signal, the first estimated anti-noise signal and the estimated noise signal; a second virtual error signal generator configured to generate a second virtual error signal from the second estimated anti-noise signal and the estimated noise signal; an adjustment filter coefficient updater configured to update a coefficient of the adjustment filter, successively and adaptively, so as to minimize the magnitude of the first virtual error signal, based on the control target signal and the first virtual error signal; a secondary path transfer filter coefficient updater configured to update a coefficient of the secondary path transfer filter, successively and adaptively, so as to minimize the magnitude of the first virtual error signal, based on the control signal and the first virtual error signal; and a control filter coefficient updater configured to update a coefficient of the control filter, successively and adaptively, so as to minimize the magnitude of the second virtual error signal, based on the reference signal and the second virtual error signal.

According to the present invention, excellent noise reduction performance can be ensured even when the transfer characteristic changes.

The above and other objects, features, and advantages of the present invention will become more apparent from the following description when taken in conjunction with the accompanying drawings, in which preferred embodiments of the present invention are shown by way of illustrative example.

DESCRIPTION OF THE PREFERRED EMBODIMENTS

First Embodiment

Figure 1:
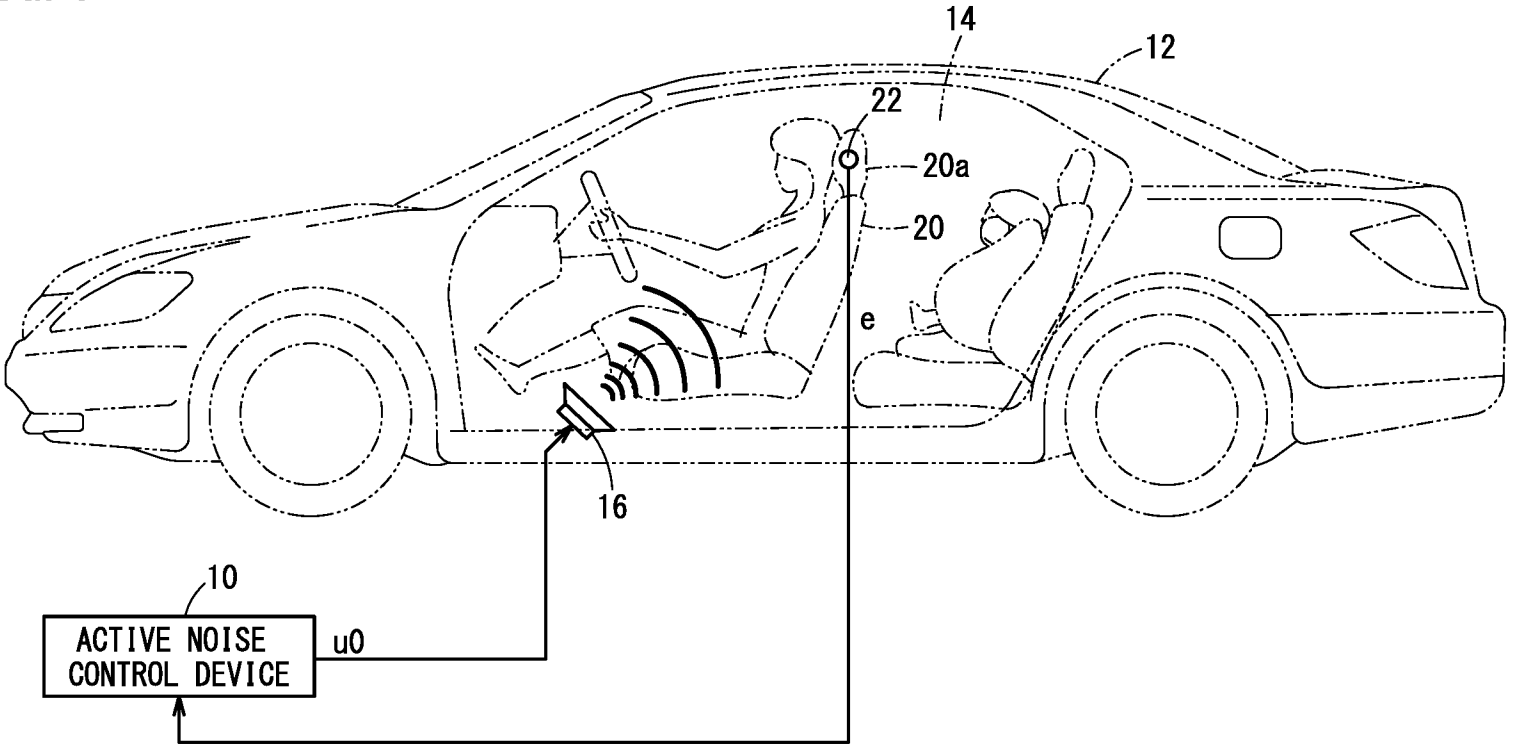
FIG. 1 is a diagram illustrating an outline of active noise control.

FIG. 1 is a diagram illustrating an outline of active noise control achieved by an active noise control device 10.

Wheels vibrate due to a force received from a road surface, and this vibration is transmitted to the vehicle body via the suspension, and road noise arises in a vehicle passenger compartment 14. The road noise has its peak at around 40 to 50 Hz, which is caused by the acoustic resonance characteristics of a closed space such as the vehicle passenger compartment 14. This narrow band component having a constant bandwidth is called a drumming noise, which generates a dull humming sound or muffled sound, e.g., "zoom or boom", and is liable to make the occupants feel uneasy.

The active noise control device 10 of the present embodiment outputs an anti-noise sound (noise cancelling sound) from a speaker 16 installed in the vehicle passenger compartment 14 of the vehicle 12 to cancel the drumming noise in the vehicle passenger compartment 14. The active noise control device 10 generates a control signal u0 for causing the speaker 16 to output an anti-noise sound based on an error signal e output from a microphone 22 arranged on a headrest 20*a* of a seat 20 in the vehicle passenger compartment 14. The error signal e is a signal that is output, according to a canceling error noise, from the microphone 22 detecting the canceling error noise which is a combination of the anti-noise sound and the drumming noise. The speaker 16 corresponds to the control actuator of the present invention, and the microphone 22 corresponds to the error detector of the present invention.

Figure 2:
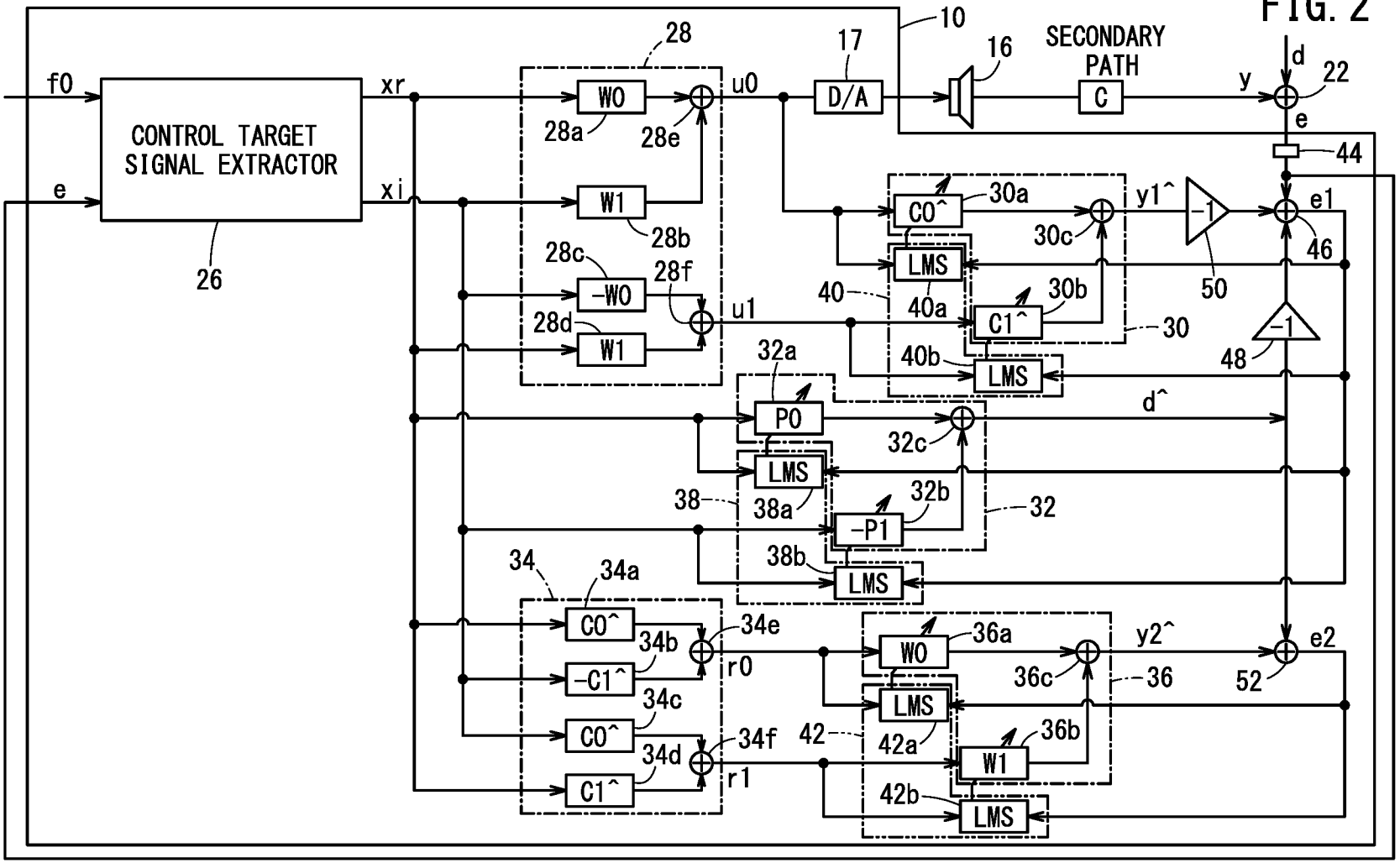
FIG. 2 is a block diagram of an active noise control device.

FIG. 2 is a block diagram of the active noise control device 10. In the following, drumming noise may be referred to as noise. Additionally, the transmission path from the speaker 16 to the microphone 22 may be referred to as a secondary path hereinbelow.

The active noise control device 10 includes a control target signal extractor 26, a control signal generator 28, a first estimated anti-noise signal generator 30, an estimated noise signal generator 32, a reference signal generator 34, a second estimated anti-noise signal generator 36, an adjustment filter coefficient updater 38, a secondary path transfer filter coefficient updater 40, and a control filter coefficient updater 42.

The active noise control device 10 has an arithmetic processing unit and a storage (not shown). The arithmetic processing unit includes, for example, a processor such as a central processing unit (CPU), a microprocessing unit (MPU), and memory devices of non-transitory or transitory tangible computer-readable recording media such as ROM or RAM. The storage is, for example, a non-transitory tangible computer-readable recording medium such as a hard disk or flash memory.

The control target signal extractor 26, the control signal generator 28, the first estimated anti-noise signal generator 30, the estimated noise signal generator 32, the reference signal generator 34, the second estimated anti-noise signal generator 36, the adjustment filter coefficient updater 38, the secondary path transfer filter coefficient updater 40, and the control filter coefficient updater 42 are realized by performing arithmetic processing in the arithmetic processing unit according to programs stored in the storage.

The control target signal extractor 26 generates a control target signal xr, xi based on a control target frequency f0 and the error signal e. The control target signal extractor 26 extracts a signal component of the control target frequency f0 from the error signal e, as the control target signal xr, xi, which is a complex-valued signal having a real part and an imaginary part.

Figure 3:
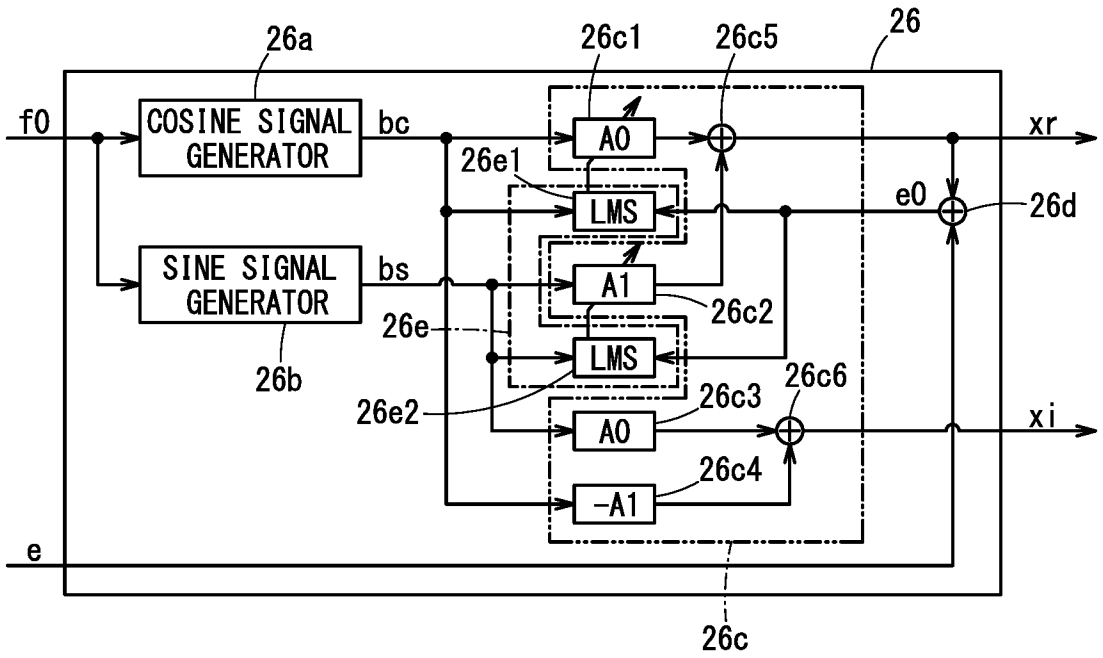
FIG. 3 is a block diagram of a control target signal extractor.

FIG. 3 is a block diagram of the control target signal extractor 26. The control target signal extractor 26 includes a cosine signal generator 26*a*, a sine signal generator 26*b*, an extraction signal generator 26*c*, an adder 26*d*, and an extraction filter coefficient updater 26*e*.

The cosine signal generator 26*a* generates a reference signal be (=cos(2πf0t)) which is a cosine signal of the control target frequency f0. The sine signal generator 26*b* generates a reference signal bs (=sin(2πf0t)) which is a sine signal of the control target frequency f0. Here, t denotes time.

In the extraction signal generator 26*c*, a SAN filter (single-frequency adaptive notch filter) is used for an extraction filter A. The extraction filter A is optimized by the extraction filter coefficient updater 26*e* (described later) updating the coefficient (A0+iA1 where "i" is the imaginary unit) of the extraction filter A.

The extraction signal generator 26*c* generates the control target signals xr, xi based on the reference signals bc and bs. The extraction signal generator 26*c* includes a first extraction filter 26*c*1, a second extraction filter 26*c*2, a third extraction filter 26*c*3, a fourth extraction filter 26*c*4, an adder 26*c*5, and an adder 26*c*6.

The first extraction filter 26*c*1 has a filter coefficient A0, which is the real part of the coefficient of the extraction filter A. The second extraction filter 26*c*2 has a filter coefficient A1, which is the imaginary part of the coefficient of the extraction filter A. The third extraction filter 26*c*3 has a filter coefficient A0, which is the real part of the coefficient of the extraction filter A. The fourth extraction filter 26*c*4 has a filter coefficient −A1, which is a value obtained by inverting the polarity of the imaginary part of the coefficient of the extraction filter A.

The reference signal bc filtered through the first extraction filter 26*c*1 and the reference signal bs filtered through the second extraction filter 26*c*2 are added at the adder 26*c*5 to generate the control target signal xr. The reference signal bs filtered through the third extraction filter 26*c*3 and the reference signal bc filtered through the fourth extraction filter 26*c*4 are added at the adder 26*c*6 to generate the control target signal xi.

The error signal e is input to the adder 26*d*. The control target signal xr generated by the extraction signal generator 26*c* is input to the adder 26*d*. The error signal e and the control target signal xr are added at the adder 26*d* to generate a virtual error signal e0.

The extraction filter coefficient updater 26*e* updates the filter coefficients A0 and A1, based on the reference signals be and bs and the virtual error signal e0. The extraction filter coefficient updater 26*e* updates the filter coefficients A0 and A1 so as to minimize the virtual error signal e0, based on an adaptive algorithm (for example, Filtered-X LMS algorithm (Least Mean Square)). The extraction filter coefficient updater 26*e* includes a first extraction filter coefficient updater 26*e*1 and a second extraction filter coefficient updater 26*e*2.

The first extraction filter coefficient updater 26*e*1 and the second extraction filter coefficient updater 26*e*2 update the filter coefficients A0 and A1, based on the following equations. In the equations, n indicates a time step (n=0, 1, 2, . . . ), and μ0 and μ1 represent step size parameters.

$$A0_{n+1}=A0_n-\mu 0\times e0_n\times bc_n$$

$$A1_{n+1}=A1_n-\mu 1\times e0_n\times bs_n$$

The filter coefficients A0 and A1 are repeatedly updated in the extraction filter coefficient updater 26*e* to thereby optimize the extraction filter A. Since the update equations for the coefficients of the extraction filter A are defined by four arithmetic operations and include no convolution operation, the calculation load due to the update processing of the filter coefficients A0 and A1 can be reduced.

Returning to FIG. 2, the control signal generator 28 generates control signals u0 and u1 based on the control target signals xr and xi. The control signal generator 28 includes a first control filter 28*a*, a second control filter 28*b*, a third control filter 28*c*, a fourth control filter 28*d*, an adder 28*e*, and an adder 28*f*.

In the control signal generator 28, a SAN filter is used for a control filter W. The control filter W includes a filter W0 for the control target signal xr and a filter W1 for the control target signal xi. The control filter W is optimized by updating W0 (the coefficient of the filter W0) and updating W1 (the coefficient of the filter W1) in the control filter coefficient updater 42 described later.

The first control filter 28*a* has a filter coefficient W0. The second control filter 28*b* has a filter coefficient W1. The third control filter 28*c* has a filter coefficient −W0. The fourth control filter 28*d* has a filter coefficient W1.

The control target signal xr corrected by the first control filter 28*a* and the control target signal xi corrected by the second control filter 28*b* are added at the adder 28*e* to generate the control signal u0. The control target signal xi corrected by the third control filter 28*c* and the control target signal xr corrected by the fourth control filter 28*d* are added at the adder 28*f* to generate the control signal u1.

The control signal u0 is converted into an analog signal by a digital-to-analog converter 17 and output to the speaker 16. The speaker 16 is controlled based on the control signal u0 and outputs anti-noise sound from the speaker 16.

The first estimated anti-noise signal generator 30 generates an estimated anti-noise signal y1ˆ based on the control signals u0 and u1. The estimated anti-noise signal y1ˆ corresponds to the first estimated anti-noise signal in the present invention. The first estimated anti-noise signal generator 30 includes a first secondary path transfer filter 30*a*, a second secondary path transfer filter 30*b*, and an adder 30*c*.

In the first estimated anti-noise signal generator 30, a SAN filter is used for a secondary path transfer filter Cˆ. In the secondary path transfer filter coefficient updater 40 detailed later, the coefficient (C0ˆ+iC1ˆ where "i" is the imaginary unit) of the secondary path transfer filter Cˆ is updated, whereby the sound transfer characteristic C of the secondary path (hereinafter, referred as the secondary path transfer characteristic C) is identified as the secondary path transfer filter Cˆ.

The first secondary path transfer filter 30*a* has a filter coefficient C0ˆ, which is the real part of the coefficient of the secondary path transfer filter Cˆ. The second secondary path transfer filter 30*b* has a filter coefficient, C1ˆ, which is the imaginary part of the coefficient of the secondary path transfer filter Cˆ. The control signal u0 corrected by the first secondary path transfer filter 30*a* and the control signal u1 corrected by the second secondary path transfer filter 30*b* are added at the adder 30*c* to generate the estimated anti-noise signal y1ˆ. The estimated anti-noise signal y1ˆ is an estimated signal of the signal corresponding to an anti-noise sound y input to the microphone 22.

The estimated noise signal generator 32 generates an estimated noise signal dˆ based on the control target signals xr and xi. The estimated noise signal generator 32 includes a first adjustment filter 32*a*, a second adjustment filter 32*b*, and an adder 32*c*.

In the estimated noise signal generator 32, a SAN filter is used for an adjustment filter P. The adjustment filter P is optimized by updating the coefficient (P0+iP1 where "i" is the imaginary unit) of the adjustment filter P in the adjustment filter coefficient updater 38 described later.

The first adjustment filter 32*a* has a filter coefficient P0, which is the real part of the coefficient of the adjustment filter P. The second adjustment filter 32*b* has a filter coefficient −P1, which is a value obtained by inverting the polarity of the imaginary part of the coefficient of the adjustment filter P. The control target signal xr corrected by the first adjustment filter 32*a* and the control target signal xi corrected by the second adjustment filter 32*b* are added at the adder 32*c* to generate the estimated noise signal dˆ. The estimated noise signal dˆ is an estimated signal of the signal corresponding to noise d input to the microphone 22.

The reference signal generator 34 generates reference signals r0 and r1 based on the control target signals xr and xi. The reference signal generator 34 includes a third secondary path transfer filter 34*a*, a fourth secondary path transfer filter 34*b*, a fifth secondary path transfer filter 34*c*, a sixth secondary path transfer filter 34*d*, an adder 34*e*, and an adder 34*f*.

In the reference signal generator 34, a SAN filter is used for a secondary path transfer filter Cˆ. The third secondary path transfer filter 34*a* has a filter coefficient C0ˆ, which is the real part of the coefficient of the secondary path transfer filter Cˆ. The fourth secondary path transfer filter 34*b* has a filter coefficient −C1ˆ, which is a value obtained by inverting the polarity of the imaginary part of the coefficient of the secondary path transfer filter Cˆ. The fifth secondary path transfer filter 34*c* has a filter coefficient C0ˆ, which is the real part of the coefficient of the secondary path transfer filter Cˆ. The sixth secondary path transfer filter 34*d* has a filter coefficient C1ˆ, which is the imaginary part of the coefficient of the secondary path transfer filter Cˆ.

The control target signal xr corrected by the third secondary path transfer filter 34*a* and the control target signal xi corrected by the fourth secondary path transfer filter 34*b* are added at the adder 34*e* to generate the reference signal r0. The control target signal xi corrected by the fifth secondary path transfer filter 34*c* and the control target signal xr corrected by the sixth secondary path transfer filter 34*d* are added at the adder 34*f* to generate the reference signal r1.

The second estimated anti-noise signal generator 36 generates an estimated anti-noise signal y2ˆ based on the reference signals r0 and r1. The estimated anti-noise signal y2ˆ corresponds to the estimated anti-noise signal of the present invention. The second estimated anti-noise signal generator 36 includes a fifth control filter 36*a*, a sixth control filter 36*b*, and an adder 36*c*.

In the second estimated anti-noise signal generator 36, a SAN filter is used for a control filter W. The control filter W is optimized by updating the coefficients W0 and W1, of the control filter W in the control filter coefficient updater 42 described later.

The fifth control filter 36*a* has a filter coefficient W0. The sixth control filter 36*b* has a filter coefficient W1.

The reference signal r0 corrected by the fifth control filter 36*a* and the reference signal r1 corrected by the sixth control filter 36*b* are added at the adder 36*c* to generate the estimated anti-noise signal y2ˆ. The estimated anti-noise signal y2ˆ is an estimated signal of a signal corresponding to the anti-noise sound y input to the microphone 22.

The analog-digital converter 44 converts the error signal e output from the microphone 22 from an analog signal to a digital signal.

The error signal e is input to the adder 46. The estimated noise signal dˆ generated by the estimated noise signal generator 32 passes through an inverter 48 where its polarity is inverted and then the inverted signal is input to the adder 46. The estimated anti-noise signal y1ˆ generated by the first estimated anti-noise signal generator 30 passes through an inverter 50 where its polarity is inverted and then the inverted signal is input to the adder 46. In the adder 46, a virtual error signal e1 is generated. The adder 46 corresponds to the first virtual error signal generator of the present invention, and the virtual error signal e1 corresponds to the first virtual error signal of the present invention.

The estimated noise signal d^ generated by the estimated noise signal generator 32 is input to the adder 52. The estimated anti-noise signal y2^ generated by the second estimated anti-noise signal generator 36 is input to the adder 52. In the adder 52, a virtual error signal e2 is generated. The adder 52 corresponds to the second virtual error signal generator of the present invention, and the virtual error signal e2 corresponds to the second virtual error signal of the present invention.

The adjustment filter coefficient updater 38 updates the filter coefficients P0 and P1, based on the control target signals xr and xi and the virtual error signal e1. The adjustment filter coefficient updater 38 updates the filter coefficients P0 and P1 so as to minimize the virtual error signal e1, based on an adaptive algorithm (for example, Filtered-X LMS algorithm). The adjustment filter coefficient updater 38 includes a first adjustment filter coefficient updater 38*a* and a second adjustment filter coefficient updater 38*b*.

The first adjustment filter coefficient updater 38*a* and the second adjustment filter coefficient updater 38*b* update the filter coefficients P0 and P1, based on the following equations. In the equations, μ2 and μ3 are step size parameters.

$$P0_{n+1}=P0_n-\mu 2\times e1_n\times xr_n$$

$$P1_{n+1}=P1_n-\mu 3\times e1_n\times xi_n$$

The adjustment filter P is optimized by repeatedly updating the filter coefficients P0 and P1 in the adjustment filter coefficient updater 38. In the adjustment filter coefficient updater 38, the update equations for the coefficients of the adjustment filter P are defined by four arithmetic operations and include no convolution operation, so that the calculation load due to the update processing of the filter coefficients P0 and P1 can be reduced.

The secondary path transfer filter coefficient updater 40 updates the filter coefficients C0^ and C1^ based on the control signals u0 and u1 and the virtual error signal e1. The secondary path transfer filter coefficient updater 40 updates the filter coefficients C0^ and C1^ so as to minimize the virtual error signal e1, based on an adaptive algorithm (for example, Filtered-X LMS algorithm). The secondary path transfer filter coefficient updater 40 includes a first secondary path transfer filter coefficient updater 40*a* and a second secondary path transfer filter coefficient updater 40*b*.

The first secondary path transfer filter coefficient updater 40*a* and the second secondary path transfer filter coefficient updater 40*b* update the filter coefficients C0^ and C1^, based on the following update equations (which will be hereinbelow referred to as "equations (3)" for convenience). In the equations, μ4 and μ5 are step size parameters.

$$C0\hat{}_{n+1}=C0\hat{}_n-\mu 4\times e1_n\times u0_n$$

$$C1\hat{}_{n+1}=C1\hat{}_n-\mu 5\times e1_n\times u1_n$$

In addition, the first secondary path transfer filter coefficient updater 40*a* and the second secondary path transfer filter coefficient updater 40*b* normalize the filter coefficients C0^ and C1^ obtained by the above update equations (3), according to the following correction formulae, respectively.

$$C0\hat{}_{n+1}=C0\hat{}_{n+1}/|C\hat{}_n+_1|$$

$$C1\hat{}_{n+1}=C1\hat{}_{n+1}/|C\hat{}_n+_1|$$

Here, |C^| is the magnitude of the secondary path transfer filter C^, and can be obtained from the following equation using the filter coefficients C0^ and C1^ after being updated by the above update equations (3).

$$|C\hat{}_{n+1}|=\sqrt{(C0_{n+1}{}^2+C1_{n+1}{}^2)}$$

Further, as |C^|, the greater one of the absolute values of the filter coefficients C0^ and C1^ after being updated by the above update equations (3) may be used.

$$|C\hat{}_{n+1}|\approx\max(|C0\hat{}_{n+1}|,|C1\hat{}_{n+1}|)$$

The secondary path transfer filter coefficient updater 40 repeatedly updates the filter coefficients C0^ and C1^, whereby the secondary path transfer characteristic C is identified as the secondary path transfer filter C^. In the secondary path transfer filter coefficient updater 40, the update equations of the filter coefficients C0^ and C1^ are defined by four arithmetic operations and include no convolution operation. Therefore, the calculation load due to the update process of the filter coefficients C0^ and C1^ can be reduced.

The control filter coefficient updater 42 updates the filter coefficients W0 and W1 based on the reference signals r0 and r1 and the virtual error signal e2. The control filter coefficient updater 42 updates the filter coefficients W0 and W1 so as to minimize the virtual error signal e2, based on an adaptive algorithm (for example, Filtered-X LMS algorithm). The control filter coefficient updater 42 includes a first control filter coefficient updater 42*a* and a second control filter coefficient updater 42*b*.

The first control filter coefficient updater 42*a* and the second control filter coefficient updater 42*b* update the filter coefficients W0 and W1 based on the following equations. In the equations, μ6 and μ7 are step size parameters.

$$W0_{+1}=W0_n-\mu 6\times e2_n\times r0_n$$

$$W1_{n+1}=W1_n-\mu 7\times e2_n\times r1_n$$

In the control filter coefficient updater 42, the control filter coefficient W is optimized by repeatedly updating the filter coefficients W0 and W1. In the control filter coefficient updater 42, the update equations of the filter coefficients W0 and W1 are defined by four arithmetic operations and include no convolution operation, so that the calculation load due to the update process of the filter coefficients W0 and W1 can be reduced.

[Experimental Result]

Figure 4A:
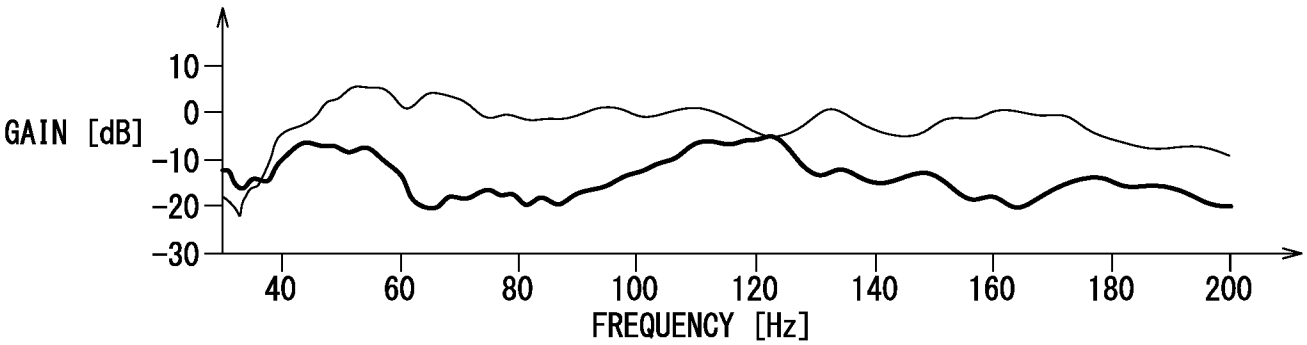
FIG. 4A is a graph showing gain characteristics.
Figure 4B:
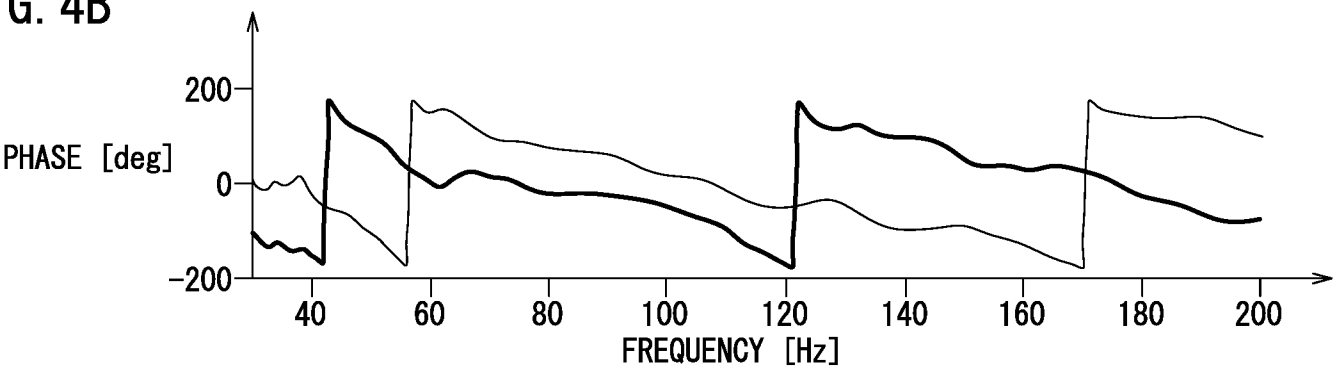
FIG. 4B is a graph showing phase characteristics.

The inventors hereof conducted experiments for examining the noise canceling performance of active noise control on drumming noise arising in the vehicle passenger compartment 14 when the vehicle 12 is driven. The experimental results are shown below. Each of the following experiments is performed under the secondary path transfer characteristic C having a gain characteristic shown by the thick line in FIG. 4A and a phase characteristic shown by the thick line in FIG. 4B. However, it is assumed that the measurement value C^ of the secondary path transfer characteristic C, measured in advance, has that of the gain characteristic plotted by the thin line in FIG. 4A and that of the phase characteristic plotted by the thin line in FIG. 4B. That is, the present inventors carried out the following experiment, presuming that the secondary path transfer characteristic C had the characteristic plotted by the thin lines when it was measured, and then changed to the characteristic plotted by the thick line at the time of active noise control.

<Experiment (1)>

In experiment (1), the sound pressure level of the drumming noise in the vehicle passenger compartment 14 is measured when the vehicle 12 is accelerated from the stopped state while active noise control is off.

<Experiment (2)>

In experiment (2), the sound pressure level of the drumming noise in the vehicle passenger compartment 14 is measured when the vehicle 12 is accelerated from the stopped state while active noise control is being performed by the method disclosed in Japanese Laid-Open Patent Publication No. 2007-025527. In this experiment, the sound pressure of the drumming noise component at the control target frequency 46 Hz is set to be halved (6 dB reduction at the sound pressure level), in the measurement value Cˆ measured in advance.

<Experiment (3)>

In experiment (3), the sound pressure level of the drumming noise in the vehicle passenger compartment 14 is measured when the vehicle 12 is accelerated from the stopped state while active noise control is being performed by the active noise control device 10 of the present embodiment. In experiment (3), the initial value of the secondary path transfer filter Cˆ was set to the measurement value Cˆ, and the initial value of the control filter W was set to the reciprocal of the measurement value Cˆ (1/Cˆ).

<<Comparison of the Results of Experiments (1) to (3)>>

Figure 5:
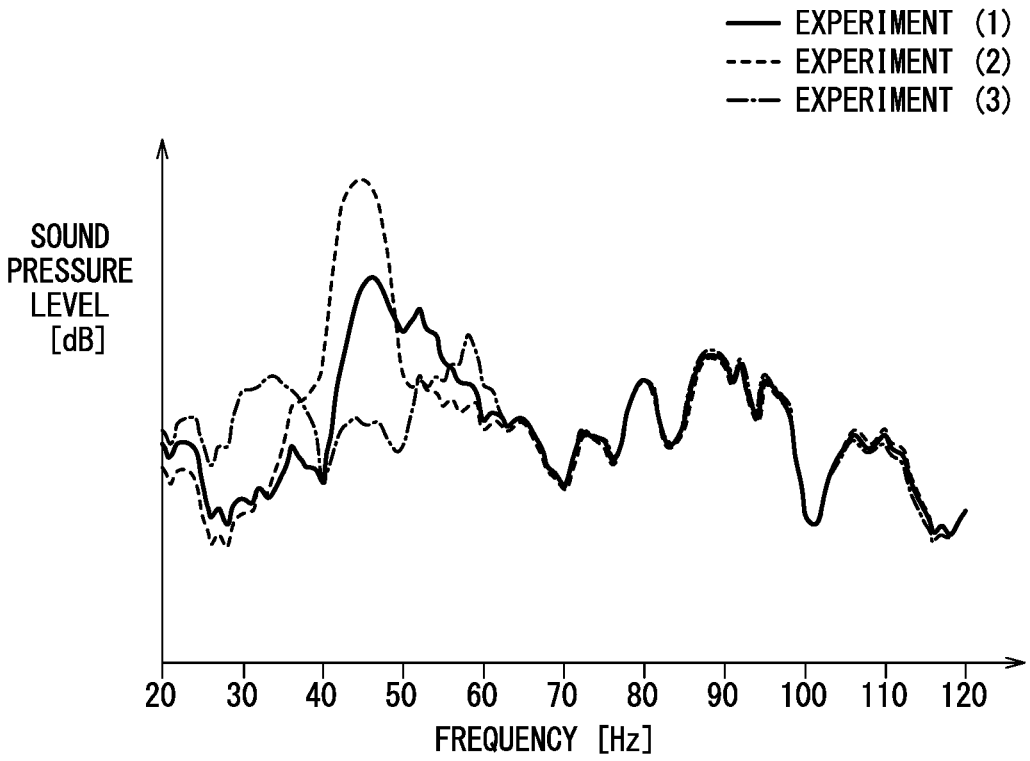
FIG. 5 is a graph showing the sound pressure level of drumming noise in a vehicle passenger compartment.

FIG. 5 is a graph showing the sound pressure levels of the drumming noise in the vehicle passenger compartment 14, measured in experiments (1) to (3).

In experiment (1), it can be understood that drumming noise of frequencies centered at 46 Hz was generated. In experiments (2) and (3), active noise control was performed by setting the control target frequency at 46 Hz.

The measurement value Cˆ measured in advance had a phase shift of 160 degrees at 46 Hz with respect to the actual secondary path transfer characteristic C. Due to the deviation of the measurement value Cˆ from the actual secondary path transfer characteristic C, the drumming noise was amplified by about 4 dB around 46 Hz in the experiment (2).

In experiment (3), since the secondary path transfer filter Cˆ was updated successively, the secondary path transfer filter Cˆ could follow the change of the actual secondary path transfer characteristic C, so that drumming noise was reduced about 8 dB at around 46 Hz.

[Operation and Effect]

Drumming noise can be eliminated by adjusting the anti-noise sound output from the speaker 16 such that the sound has opposite phase to that of the drumming noise at the occupant's ear (control point). In order to achieve such adjustment, it is necessary to estimate the sound transfer characteristic C (secondary path transfer characteristic C) from the speaker 16 to the control point with high accuracy. Conventionally, active noise control has been performed using the measurement value Cˆ of the secondary path transfer characteristic C measured in advance. However, when the secondary path transfer characteristic C changes, the measurement value Cˆ deviates from the secondary path transfer characteristic C after change. Therefore, at the control point, the anti-noise sound output from the speaker 16 cannot be adjusted so as to have a phase opposite to that of the drumming noise, which may amplify noise and/or cause abnormal sound generation disadvantageously.

To address this problem, in the active noise control device 10 of the present embodiment, the secondary path transfer filter coefficients C0ˆ and C1ˆ are updated by the secondary path transfer filter coefficient updater 40 during the active noise control, so that the updated secondary path transfer characteristic C is identified as the secondary path transfer filter Cˆ. As a result, even when the secondary path transfer characteristic C changes, the secondary path transfer filter Cˆ can change following the change of the secondary path transfer characteristic C. Therefore, even if the secondary path transfer characteristic C changes, the active noise control device 10 can secure appropriate noise cancelling performance.

The secondary path transfer filter Cˆ corresponds to the estimated value of the sound transfer characteristic C from the speaker 16 to the microphone 22. Therefore, the magnitude of the secondary path transfer filter Cˆ varies depending on setting of the control target frequency f0.

When the control target frequency f0 is set to be within a frequency band where the magnitude of the secondary path transfer filter Cˆ is small, the levels of the reference signals r0 and r1 used for updating the control filter W become lower, thereby causing the convergence of the control filter W to slow down. Further, since the control signals u0 and u1, which are the outputs of the control filter W, are used for updating the secondary path transfer filter Cˆ, the convergence of the secondary path transfer filter Cˆ itself is also slowed down.

On the other hand, when the control target frequency f0 is set to be within a frequency band where the magnitude of the secondary path transfer filter Cˆ is large, the control filter W and the secondary path transfer filter Cˆ converge faster, but the amount of updating for each update increases, so that the active noise control tends to become unstable.

To deal with this, in the present embodiment, the secondary path transfer filter coefficient updater 40 normalizes the secondary path transfer filter coefficients C0ˆ and C1ˆ. As a result, the convergence speeds of the control filter W and the secondary path transfer filter Cˆ can be made constant regardless of the magnitude of the secondary path transfer filter Cˆ.

Second Embodiment

The active noise control device 10 of this embodiment partially differs from the first embodiment in the processing of the control filter W in the control filter coefficient updater 42. The other configurations and processing in the second embodiment are the same as the first embodiment.

The first control filter coefficient updater 42*a* and the second control filter coefficient updater 42*b* update the filter coefficients W0 and W1, based on the following update equations. In the equations, μ6 and μ7 are step size parameters.

$$W0_{n+1}=W0_n-\mu 6\times e2_n\times r0_n$$

$$W1_{n+1}=W1_n-\mu 7\times e2_n\times r1_n$$

The first control filter coefficient updater 42*a* and the second control filter coefficient updater 42*b* further perform an amplitude limiting process on the filter coefficients W0 and W1 obtained by the above update equations, using the following correction formulae.

$$\text{If } |W_{n+1}|>W\text{lim}, \text{ Then } W0_{n+1}=W\text{lim}/|W_{n+1}|\times W0_{n+1} \text{ and } W1_{n+1}=W\text{lim}/|W_{n+1}|\times W1_{n+1}$$

Here, |W| is the magnitude of the control filter coefficient, and can be obtained from the following equation.

$$|W_{n+1}|=\sqrt{(W0\hat{}_{n+1}{}^2+W1\hat{}_{n+1}{}^2)}$$

Further, as |W|, the greater one of the absolute values of the filter coefficients W0 and W1 may be used. This can reduce the amount of calculation.

$$|W_{n+1}|\approx\max(|W0_{n+1}|,|W1_{n+1}|)$$

Wlim is set to an appropriate positive number. When it is desired to perform active noise control with a specific magnitude of noise to be cancelled being set, Wlim may be set based on the following feedback control sensitivity function. In the equation, E is the frequency characteristic of the error signal e, and D is the frequency characteristic of the noise d.

$$S=E/D=1/(1+W\times\hat{C})$$

When $|S|<1$, then $E<D$, so that the noise can be cancelled. For example, when it is desired to reduce the noise d by 6 dB, the following relation can be obtained:

$$S=E/D=1/(1+W\times\hat{C})=10^{-6/20}\approx 1/2$$

$$W=1/(\hat{C})$$

Therefore, if Wlim is set to $|1/\hat{C}|$ ($Wlim=|1/\hat{C}|$) using the measurement value $\hat{C}$ measured in advance, noise reduction by about 6 dB can be achieved.

Further, the first control filter coefficient updater 42*a* and the second control filter coefficient updater 42*b* may perform an amplitude limiting process on the filter coefficients W0 and W1 obtained by the above update equations, using the following correction formulae. In the equations, η is the damping coefficient ($0<\eta<1$).

If $|W_{n+1}|>Wlim$, Then $W0_{n+1}=\eta\times W0_{n+1}$ and $W1_{n+1}=\eta\times W1_1$

[Experimental Result]

The inventors hereof conducted experiments for examining the noise canceling performance on drumming noise arising in the vehicle passenger compartment 14 when the vehicle 12 is driven. The experimental results are shown below. Each of the following experiments is performed under the secondary path transfer characteristic C having a gain characteristic shown by the thick line in FIG. 4A and a phase characteristic shown by the thick line in FIG. 4B. However, it is assumed that the measurement value $\hat{C}$ of the secondary path transfer characteristic C, measured in advance, has that of the gain characteristic plotted by the thin line in FIG. 4A and that of the phase characteristic plotted by the thin line in FIG. 4B.

<Experiment (4)>

In experiment (4), the sound pressure level of the noise in the vehicle passenger compartment 14 is measured when the vehicle 12 is accelerated from the stopped state while active noise control is being performed by the active noise control device 10 of the present embodiment. In experiment (4), the initial value of the secondary path transfer filter $\hat{C}$ was set to the measurement value $\hat{C}$, and the initial value of the control filter W was set to the reciprocal of the measurement value $\hat{C}$ ($1/\hat{C}$). Further, Wlim was set to $|1/\hat{C}|$ ($Wlim=|1/\hat{C}|$) so as to reduce the drumming noise level by 6 dB.

<<Comparison of the Results of Experiments (1), (3) and (4)>>

Figure 6:
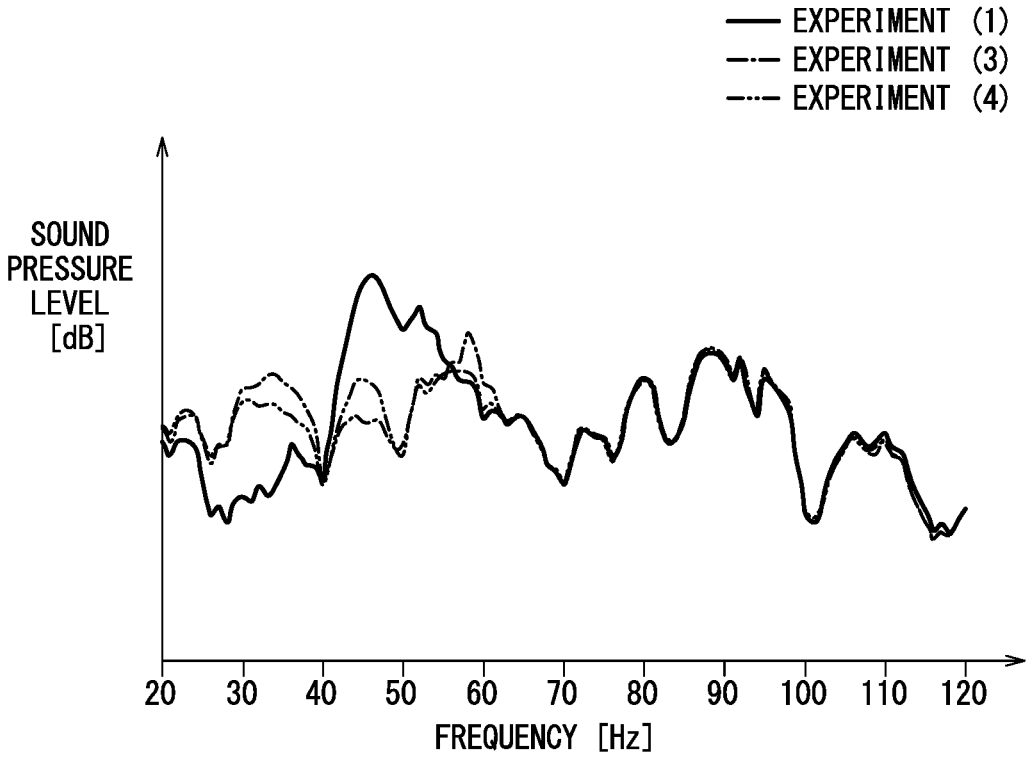
FIG. 6 is a graph showing the sound pressure level of drumming noise in a vehicle passenger compartment.

FIG. 6 is a graph showing the sound pressure levels of the noise in the vehicle passenger compartment 14, measured in experiments (1), (3) and (4).

In experiment (1), it can be understood that drumming noise of frequencies centered at 46 Hz was generated. In experiments (3) and (4), active noise control was performed by setting the control target frequency at 46 Hz.

In experiment (3), since the secondary path transfer filter $\hat{C}$ was updated successively, the secondary path transfer filter $\hat{C}$ could follow the change of the actual secondary path transfer characteristic C, so that drumming noise was reduced about 8 dB at around 46 Hz. However, noise amplification called the waterbed effect occurred in the frequency bands of 25-40 Hz and 57-62 Hz, away from 46 Hz. In particular, peaks around 35 Hz and 58 Hz were conspicuous. This occurs because in feedback control, the circuit characteristics are adjusted so that the noise can be canceled only in a narrow band centered on the control target frequency f0, whereas in the frequency bands away from the control target frequency f0, there occurs an error between the circuit characteristics and the ideal characteristics.

In experiment (4), the noise amplification due to the waterbed effect around 35 Hz and 58 Hz is alleviated by setting the noise reduction rating around 46 Hz, which is the control target frequency f0, to about 6 dB. As shown in FIG. 6, the drumming noise after active noise control has no conspicuous peaks and has a flat characteristic over all frequencies.

[Operation and Effect]

In the active noise control device 10 of the present embodiment, when the coefficients W0 and W1 of the control filter W after updating by the updating formulae are greater than the predetermined value Wlim, the control filter coefficient updater 42 revises the filter coefficients W0 and W1 to the predetermined value Wlim. As a result, it is possible to suppress an increase in noise in a frequency band outside the control target frequency f0.

Third Embodiment

The active noise control devices 10 of the first and second embodiments cancel the drumming noise of the frequency component of a single control target frequency f0. In the active noise control device 10 of the third embodiment, the drumming noises of n frequency components corresponding to control target frequencies f0 to fn-1 are cancelled.

Figure 7:
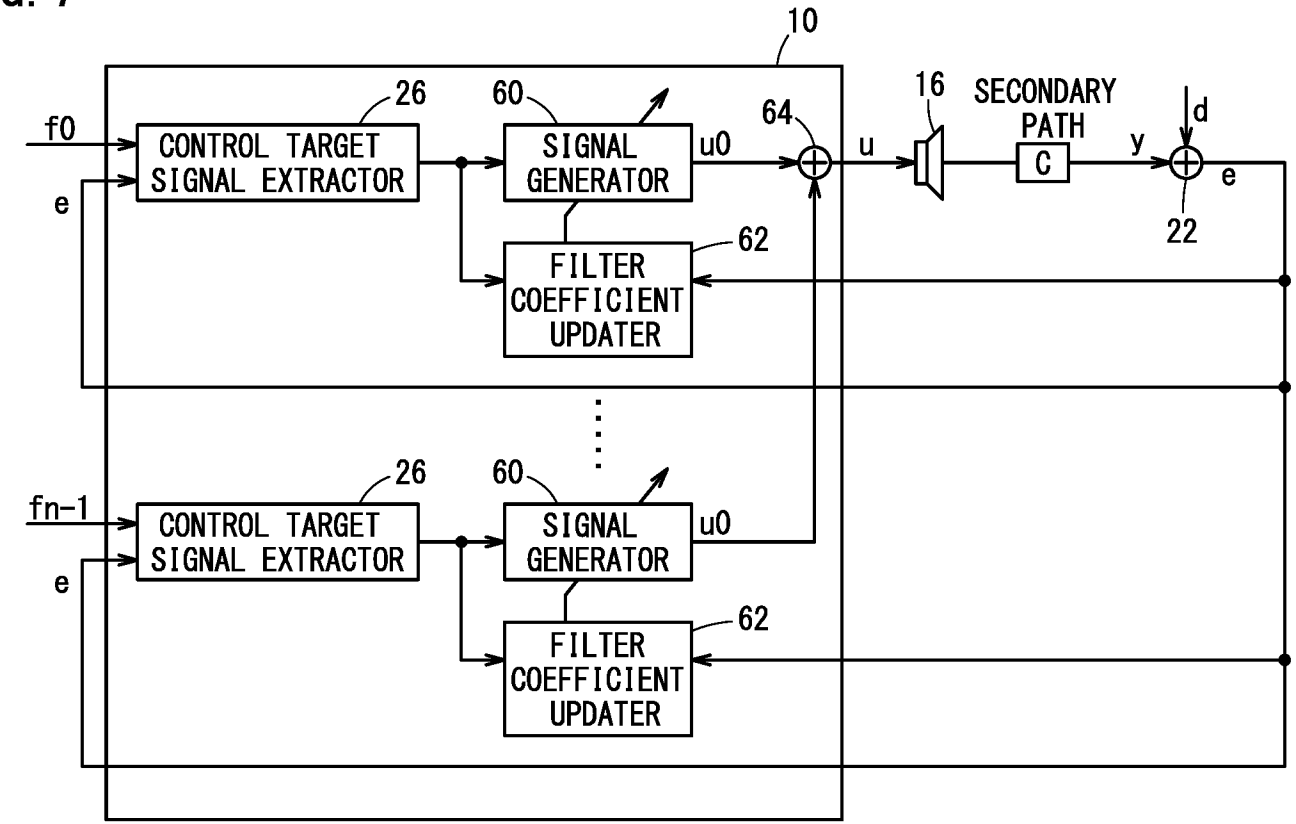
FIG. 7 is a block diagram of an active noise control device.

FIG. 7 is a block diagram of an active noise control device 10. In FIG. 7, the control signal generator 28, the first estimated anti-noise signal generator 30, the estimated noise signal generator 32, the reference signal generator 34 and the second estimated anti-noise signal generator 36 shown in FIG. 2 are integrated as a signal generator 60. Further, in FIG. 7, the adjustment filter coefficient updater 38, the secondary path transfer filter coefficient updater 40, and the control filter coefficient updater 42 shown in FIG. 2 are integrated as a filter coefficient updater 62.

The processing performed by the control signal generator 28, the first estimated anti-noise signal generator 30, the estimated noise signal generator 32, the reference signal generator 34 and the second estimated anti-noise signal generator 36 of the signal generator 60 is the same as that of the first embodiment or the second embodiment. The processing performed by the adjustment filter coefficient updater 38, the secondary path transfer filter coefficient updater 40 and the control filter coefficient updater 42 of the filter coefficient updater 62 is the same as that of the first embodiment or the second embodiment.

In the active noise control device 10 of the present embodiment, the control target signal extractor 26, the signal generator 60 and the filter coefficient updater 62 are provided for each of the control target frequencies f0 to fn-1. The control signals u0 generated by all the signal generators 60 are summed at the adder 64 to be output to the speaker 16 as a control signal u.

[Operation and Effect]

In the active noise control device 10 of the present embodiment, the control target signal extractor 26, the signal generator 60 and the filter coefficient updater 62 are provided for each of the control target frequencies f0 to fn-1.

This makes it possible to eliminate the drumming noise at multiple control target frequencies f0 to fn-1.

Modification 1

The active noise control devices 10 of the first to third embodiments are configured to output an anti-noise sound from the speaker 16 provided in the vehicle passenger compartment 14 of the vehicle 12 to cancel the noise. However, an actuator 70 provided on the engine mount supporting an engine 18 may be configured to output a canceling vibration that cancels the vibration of the engine 18.

Figure 8:
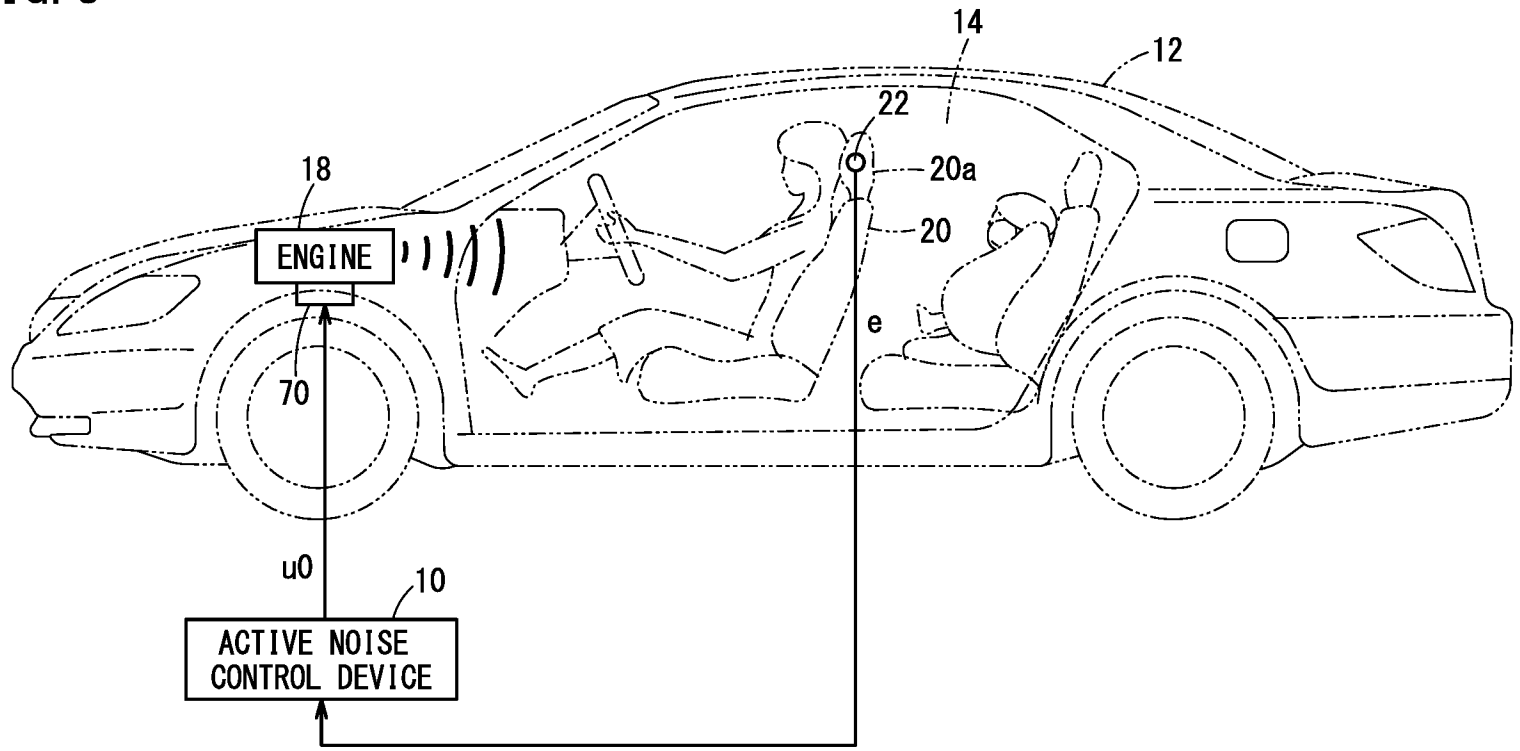
FIG. 8 is a diagram illustrating an outline of active noise control.

FIG. 8 is a diagram illustrating an outline of active noise control executed by the active noise control device 10.

The active noise control device 10, based on the error signal e output from the microphone 22 provided on the headrest 20*a* of the seat 20 in the vehicle passenger compartment 14, generates a control signal u0 for causing the actuator 70 to output the canceling vibration. In this case, the secondary path is the transmission path from the actuator 70 to the microphone 22.

Modification 2

In order to improve the initial convergence of the active noise control, the active noise control device 10 may be provided with a device, a unit, a section, a circuit, or the like for holding and setting appropriate initial values of the control filter W and the secondary path transfer filter C^.

The ROM in the memory of the active noise control device 10 is provided with an area for storing the initial values of the coefficients W0 and W1 of the control filter W and the coefficients C0^ and C1^ of the secondary path transfer filter C^. At the start of active noise control, the initial values of the coefficients W0 and W1 and the coefficients C0^ and C1^ are read from the ROM into the control filter W and the secondary path transfer filter C^, whereby adaptive updating is started.

The initial value of the secondary path transfer filter C^ may use the measurement value C^, that is measured in advance at the control target frequency f0. The initial value of the control filter W may use the reciprocal (1/C^) of the measured, measurement value C^.

At the end of active noise control, the coefficients W0 and W1 of the control filter W, the initial value of the coefficients C0^ and C1^ of the secondary path transfer filter C^, stored in the ROM of the memory may be rewritten depending on the cause of the control ending and the settings of system parameters. The rewriting of the initial values should be performed only when the active noise control is normally completed and when "rewritable" is set as the system parameter. When the active noise control is terminated due to divergence, or when "unrewritable" is set as the system parameter, the initial value is not rewritten.

Technical Idea Obtained from the Embodiments

The technical ideas that can be grasped from the above embodiments are described below.

An active noise control device (10) that performs active noise control for controlling a control actuator (16, 70) based only on an error signal output from an error detector (22) that detects sound pressure or vibration at a control point, includes: a control target signal extractor (26) that extracts a signal component of a control target frequency from the error signal as a control target signal which is a complex-valued signal having a real part and an imaginary part; a control signal generator (28) configured to generate a control signal for controlling the control actuator, by signal-processing the control target signal through a control filter that is an adaptive notch filter; an estimated noise signal generator (32) configured to generate an estimated noise signal by signal-processing the control target signal through an adjustment filter that is an adaptive notch filter; a first estimated anti-noise signal generator (30) configured to generate a first estimated anti-noise signal by signal-processing the control signal through a secondary path transfer filter that is an adaptive notch filter; a reference signal generator (34) configured to generate a reference signal by signal-processing the control target signal through the secondary path transfer filter; a second estimated anti-noise signal generator (36) configured to generate a second estimated anti-noise signal by signal-processing the reference signal through the control filter; a first virtual error signal generator (46) configured to generate a first virtual error signal from the error signal, the first estimated anti-noise signal and the estimated noise signal; a second virtual error signal generator (52) configured to generate a second virtual error signal from the second estimated anti-noise signal and the estimated noise signal; an adjustment filter coefficient updater (38) configured to update the coefficient of the adjustment filter successively and adaptively, so as to minimize the magnitude of the first virtual error signal, based on the control target signal and the first virtual error signal; a secondary path transfer filter coefficient updater (40) configured to update the coefficient of the secondary path transfer filter successively and adaptively, so as to minimize the magnitude of the first virtual error signal, based on the control signal and the first virtual error signal; and a control filter coefficient updater (42) configured to update the coefficient of the control filter successively and adaptively, so as to minimize the magnitude of the second virtual error signal, based on the reference signal and the second virtual error signal.

In the above active noise control device, when the magnitude of the coefficient of the control filter after being updated is greater than a predetermined value, the control filter coefficient updater may revise the magnitude of the coefficient of the control filter to the predetermined value.

The above active noise control device may have the control target signal extractor, the control signal generator, and the control filter coefficient updater, for each of a plurality of the control target frequencies.

The present invention is not particularly limited to the embodiment described above, and various modifications are possible without departing from the essence and gist of the present invention.

What is claimed is:

1. An active noise control device that performs active noise control for controlling a control actuator based only on an error signal output from an error detector that detects sound pressure or vibration at a control point, the active noise control device comprising one or more processors that execute computer-executable instructions stored in a memory, wherein the one or more processors execute the computer-executable instructions to cause the active noise control device to:

extract a signal component of a control target frequency from the error signal as a control target signal which is a complex-valued signal having a real part and an imaginary part;

generate a control signal for controlling the control actuator, by signal-processing the control target signal through a control filter that is an adaptive notch filter;

generate an estimated noise signal by signal-processing the control target signal through an adjustment filter that is an adaptive notch filter;

generate a first estimated anti-noise signal by signal-processing the control signal through a secondary path transfer filter that is an adaptive notch filter;

generate a reference signal by signal-processing the control target signal through the secondary path transfer filter;

generate a second estimated anti-noise signal by signal-processing the reference signal through the control filter;

generate a first virtual error signal from the error signal, the first estimated anti-noise signal, and the estimated noise signal;

generate a second virtual error signal from the second estimated anti-noise signal and the estimated noise signal;

update a coefficient of the adjustment filter successively and adaptively, so as to minimize magnitude of the first virtual error signal, based on the control target signal and the first virtual error signal;

update a coefficient of the secondary path transfer filter successively and adaptively, so as to minimize the magnitude of the first virtual error signal, based on the control signal and the first virtual error signal; and update a coefficient of the control filter successively and adaptively, so as to minimize magnitude of the second virtual error signal, based on the reference signal and the second virtual error signal.

2. The active noise control device according to claim 1, wherein when magnitude of the coefficient of the control filter after being updated is greater than a predetermined value, the one or more processors cause the active noise control device to revise the magnitude of the coefficient of the control filter to the predetermined value.

3. The active noise control device according to claim 1, wherein the control target frequency comprises a plurality of control target frequencies, and for each of the plurality of control target frequencies, the one or more processors cause the active noise control device to:

extract a signal component of the control target frequency from the error signal as a control target signal which is a complex-valued signal having a real part and an imaginary part;

generate a control signal for controlling the control actuator, by signal-processing the control target signal through a control filter that is an adaptive notch filter; and update the coefficient of the control filter successively and adaptively, so as to minimize the magnitude of the second virtual error signal, based on the reference signal and the second virtual error signal.

* * * * *